US005209361A

United States Patent [19]

Grubb, Jr.

[11] Patent Number: 5,209,361

[45] Date of Patent: May 11, 1993

[54] MULTIPLE-CABLE LIFTING HEAD WITH LOAD WEIGHING MECHANISM FOR AERIAL BOOMS AND CRANES

[76] Inventor: Lloyd T. Grubb, Jr., Rte. 7, Box 250, Apex, N.C. 27502

[21] Appl. No.: 785,555

[22] Filed: Oct. 31, 1991

[51] Int. Cl.[5] ..... B66C 13/16

[52] U.S. Cl. ..... 212/158; 212/250; 414/21

[58] Field of Search ..... 212/148, 158, 250; 414/21; 340/685

[56] References Cited

U.S. PATENT DOCUMENTS

| | | | |
|---|---|---|---|
| 1,435,603 | 11/1922 | Hanser | 212/158 |
| 2,022,844 | 11/1934 | Christian | 265/52 |
| 2,646,273 | 10/1949 | Wetsel | 265/47 |
| 2,769,945 | 11/1956 | Stone et al. | 318/29 |
| 3,129,821 | 4/1964 | Graham et al. | 212/150 |
| 3,505,514 | 11/1967 | Fathauer | 235/189 |
| 3,534,355 | 3/1967 | Fathauer | 340/267 |
| 3,638,212 | 1/1972 | Peter et al. | 340/267 C |
| 3,965,464 | 6/1976 | Kozai | 340/267 C |
| 3,990,584 | 11/1976 | Strawson et al. | 212/39 MS |
| 4,098,410 | 7/1978 | Nixon et al. | 212/39 MS |
| 4,222,551 | 9/1980 | Simon | 414/21 |
| 4,732,286 | 3/1988 | Koenig | 212/149 |
| 4,746,024 | 5/1988 | Hensler | 212/158 |
| 4,854,406 | 8/1989 | Appleton et al. | 414/21 |
| 5,004,392 | 4/1991 | Naab | 414/21 |
| 5,065,829 | 11/1991 | Smith | 414/21 |

OTHER PUBLICATIONS

Iowa Mold Tooling Co., Inc. advertisement entitled "Recyclable Materials Container Handling Systems".

Iowa Mold Tooling Co., Inc. advertisement entitled "Crane Efficiently Handles Containers".

*Primary Examiner*—Joseph F. Peters, Jr.
*Assistant Examiner*—Thomas J. Brahan
*Attorney, Agent, or Firm*—Richard E. Jenkins

[57] ABSTRACT

Load cells are provided at the fixed end of each cable of a multiple-cable lifting head adapted for use at the free end of a knuckle boom or other aerial crane for lifting and operating "IGLOO" recyclable waste containers and the like. The load cells provided with each selectively controllable cable of the multiple-cable lifting head provide a signal through a J Box to a remote scale indicator at the base of the knuckle boom or crane in order to facilitate weighing the container at the beginning and end of the waste removal process so as to accurately determine the waste weight simultaneously with the removal thereof from the container.

23 Claims, 4 Drawing Sheets

MULTIPLE-CABLE LIFTING HEAD WITH LOAD WEIGHING MECHANISM FOR AERIAL BOOMS AND CRANES

DESCRIPTION

1 Technical Field

The present invention relates to lifting heads for aerial booms and cranes, and more particularly to multiple-cable lifting heads used with truck-mounted knuckle booms for emptying "IGLOO" recycling containers into the collection bins of the trucks.

2. Related Art

"IGLOO" recycling containers for collecting reusable waste material have been in use in Europe for a number of years and more recently have been placed into use in the United States. These recycling containers typically have a capacity up to 5 cubic yards and are provided with 1–3 trap doors at the bottom or side thereof for emptying the contents of the container while it is held suspended over a reusable waste collection bin. The "IGLOO" containers are typically provided with a fixed ring at the top thereof for engagement by a first cable and an additional hook for each trap door for engagement by one or more additional cables. A three compartment "IGLOO" container does not utilize a fixed support ring but is suspended and operated by means of three movable hooks connected to the three compartment trap doors. Thus, the "IGLOO" containers may be lifted by a truck-mounted knuckle boom utilizing a lifting head with multiple and separately operable cables in order to position them over the collection bin into which the reusable waste materials are to be collected. Next, the one or more lifting head cables connected to the one or more trap doors of the "IGLOO" containers are retracted or extended as required in order to deposit the recycling materials into the collection bin of the reusable waste collecting truck, and the knuckle boom and lifting head are manipulated so as to close the trap doors and to replace the "IGLOO" recycling containers onto their original sites adjacent the reusable waste collecting truck.

In view of the increased emphasis in the last several years upon collecting and selling of recyclable waste materials, it has become increasingly important to weigh the contents of recyclable waste containers such as "IGLOO" containers. A significant shortcoming of presently known multiple-cable lifting heads used with truck-mounted knuckle boom cranes to empty "IGLOO" containers has been the inability to simultaneously weigh the contents of the container during the lifting/emptying/replacement operating cycle. Applicant has overcome this significant shortcoming of presently known lifting heads with the lifting head of the instant invention which is described in detail hereinbelow. Also, although applicant contemplates that a preferred use of the novel multiple-cable lifting head with load weighing mechanism is in conjunction with truck-mounted aerial booms for handling "IGLOO"-type recycling containers, applicant further contemplates many other applications of the novel lifting head and considers all applications thereof to be within the scope of the invention as described and claimed herein.

Although applicant is not aware of any multiple-cable container lifting and operating heads for aerial booms or cranes which incorporate a mechanism adapted to provide accurate simultaneous load weighing capability, several patent references are known to applicant which bear some pertinence to the present invention. For example, U.S. Pat. No. 4,746,024 to Hensler discloses a truck-mounted aerial boom of the type having a bucket for a worker mounted adjacent the outer end thereof. A hydraulic tensiometer is positioned on the free end of the boom in close proximity to the bucket so that the worker therein can see the tensiometer and determine whether the load on the cable is within acceptable limits.

Similarly, U.S. Pat. No. 2,646,273 to Wetsel discloses a weight indicator for cranes to measure the weight of a load suspended therefrom. The invention provides for threading the lifting cable through a fluid pressure creating device mounted on the boom which is connected to a fluid pressure gauge in the crane cab so that tension applied to the cable by a load creates a weight reading on the gauge. Also, U.S. Pat. Nos. 3,505,514 and 3,534,355 to Fathauer disclose a load warning device for a truck-mounted crane which utilizes a load cell to sense the weight of the load being lifted and an angle transducer mounted on the boom to sense the angle of the boom with respect to a horizontal line. Both the load cell and the angle transducer are electrically connected to a control unit which processes the electrical signals and serves to actuate an alarm when a safe load limit for the crane has been exceeded.

Therefore, the present state of the art does not provide for a multiple-cable lifting head for use with a knuckle boom aerial crane or the like in lifting and operating "IGLOO" recyclable waste containers which is simultaneously capable of accurately weighing the contents of the containers.

DISCLOSURE OF THE INVENTION

The invention comprises a multiple-cable lifting head adapted to be mounted on the free end of an aerial boom or crane in order to lift and operate an object such as an "IGLOO" recyclable waste container. A force detection means is secured to each of the plurality of extendible and retractable load support cables of the lifting head in order to provide an electrical signal which is processed by suitable circuit means to measure the weight of the load supported by the cables. Thus, the multiple-cable lifting head of the present invention provides for handling and operating an "IGLOO"-type recyclable waste container while simultaneously and accurately weighing the contents thereof.

It is therefore the object of the present invention to provide an improved lifting head for lifting and operating recyclable waste containers which can simultaneously and accurately measure the weight of the contents of the container.

It is another object of the present invention to provide an improved multiple-cable lifting head for use in handling and operating "IGLOO" recyclable waste containers which simultaneously provides for an accurate measurement of the contents of the container.

Some of the objects of the invention having been stated, other objects will become evident as the description proceeds, when taken in connection with the accompanying drawings.

BEST MODE FOR CARRYING OUT THE INVENTION

Figure 1:
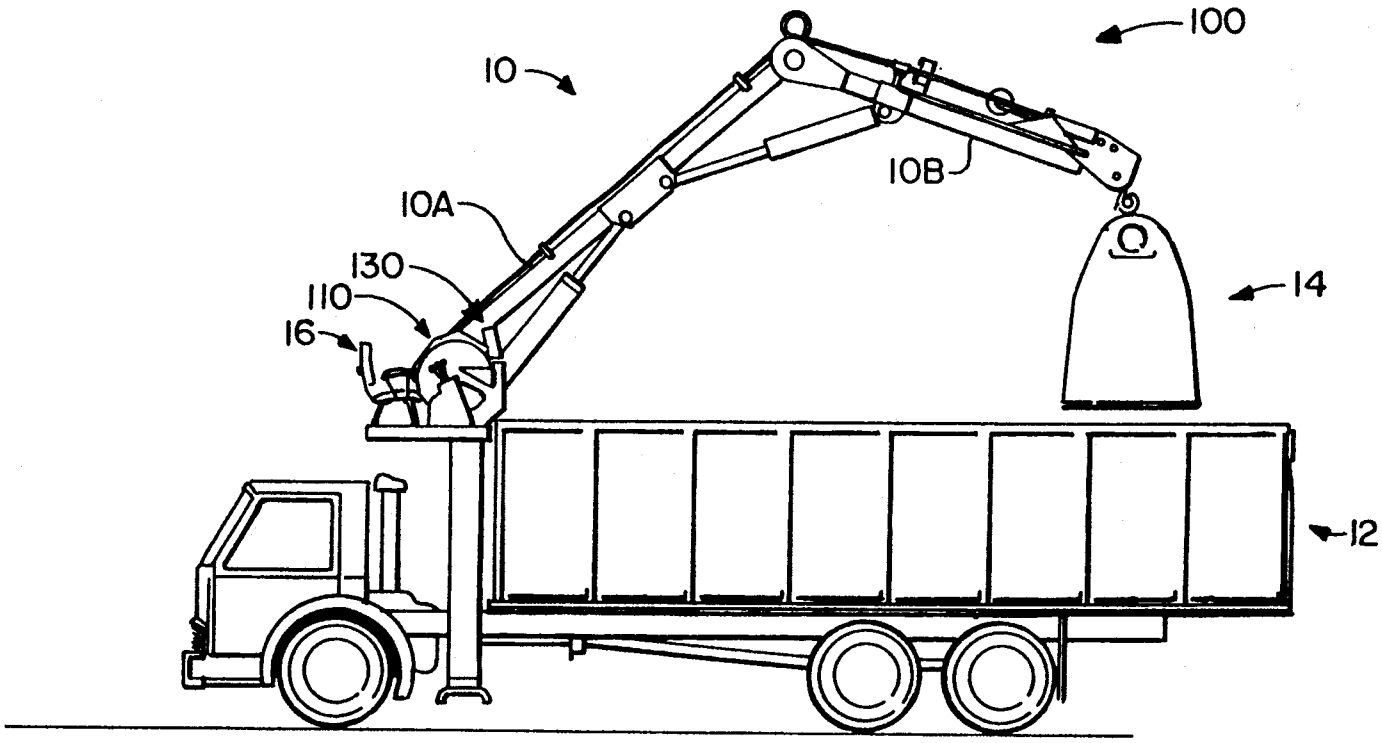
FIG. 1 is a side elevational view of a knuckle boom crane utilizing the multiple-cable lifting head of the present invention.

Referring now to FIG. 1 of the drawings, there is shown an aerial lift or "knuckle boom" crane to which the apparatus of this invention is attached. The knuckle boom lifting crane 10 is mounted on a motorized recyclable waste collection truck 12 and includes lower boom arm 10A and upper boom arm 10B which are articulated so as to be capable of lifting an "IGLOO" recyclable waste container 14 from a ground site, emptying the contents into the collection bin of truck 12, and then returning empty "IGLOO" container 14 to its original ground site location.

Movement of knuckle boom lifting crane 10 is accomplished by an operator located at seat station 16 wherein hydraulic valve controls (not shown) are provided for selective actuation of knuckle boom lifting crane 10. The load weighing lifting head apparatus of the invention is provided at the end of upper boom arm 10B and generally designated 100. Lifting head apparatus 100 includes a plurality of double-acting hydraulic cylinders (not shown in FIG. 1) for manipulating "IGLOO" container 14 which are actuated by hydraulic valve control means 110 located at seat station 16. Also, lifting head apparatus 100 includes load cells (not shown in FIG. 1) to provide a reading of the weight of "IGLOO" container 14 during operation thereof by lifting head apparatus 100 which is displayed by weight scale indicator 130 also provided at operator seat station 16. The specific details of the construction and operation of lifting head apparatus 100 will be described hereinafter.

Figure 2:
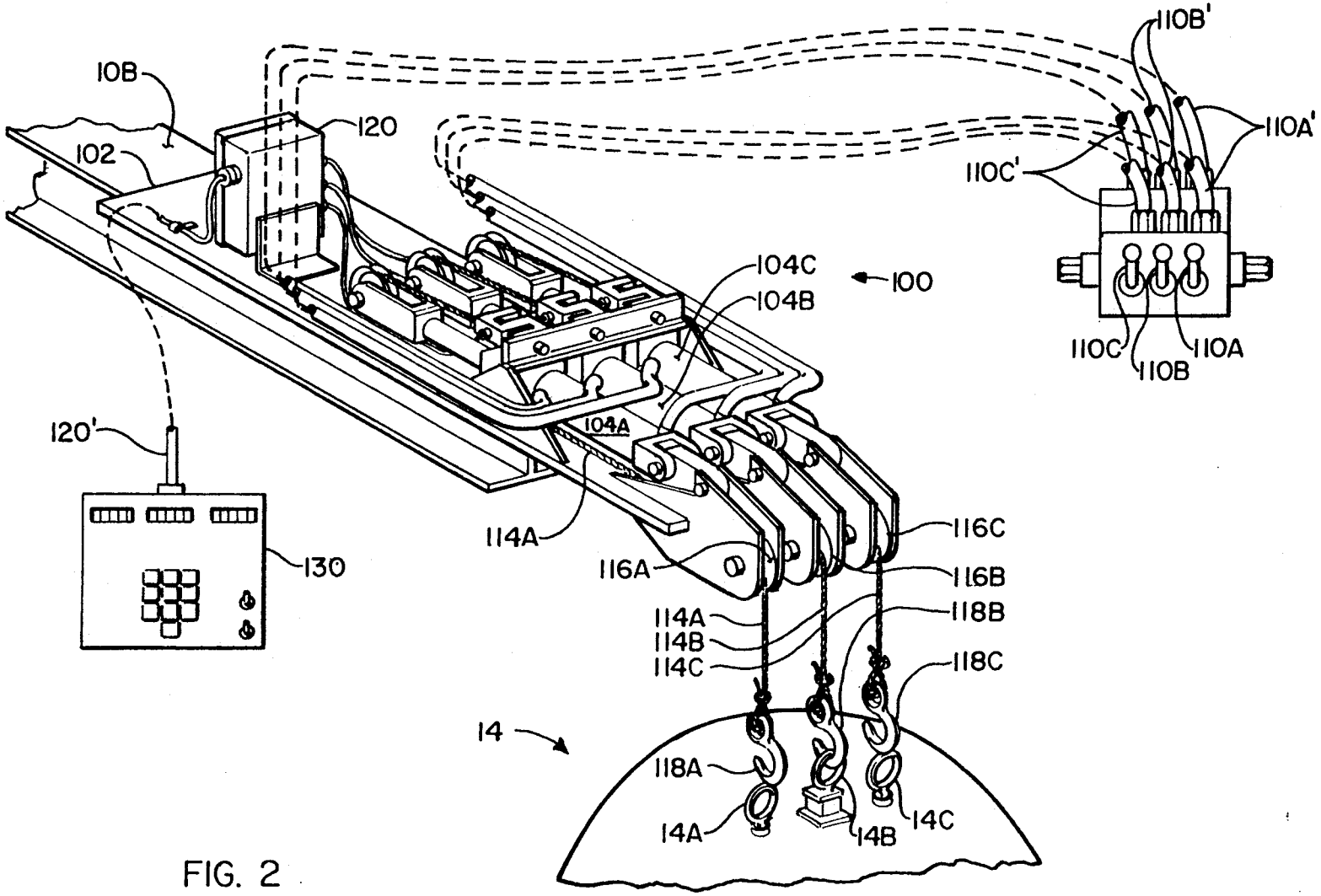
FIG. 2 is a perspective view of the multiple-cable lifting head of the present invention positioned on the free end of a knuckle boom crane.
Figure 3:
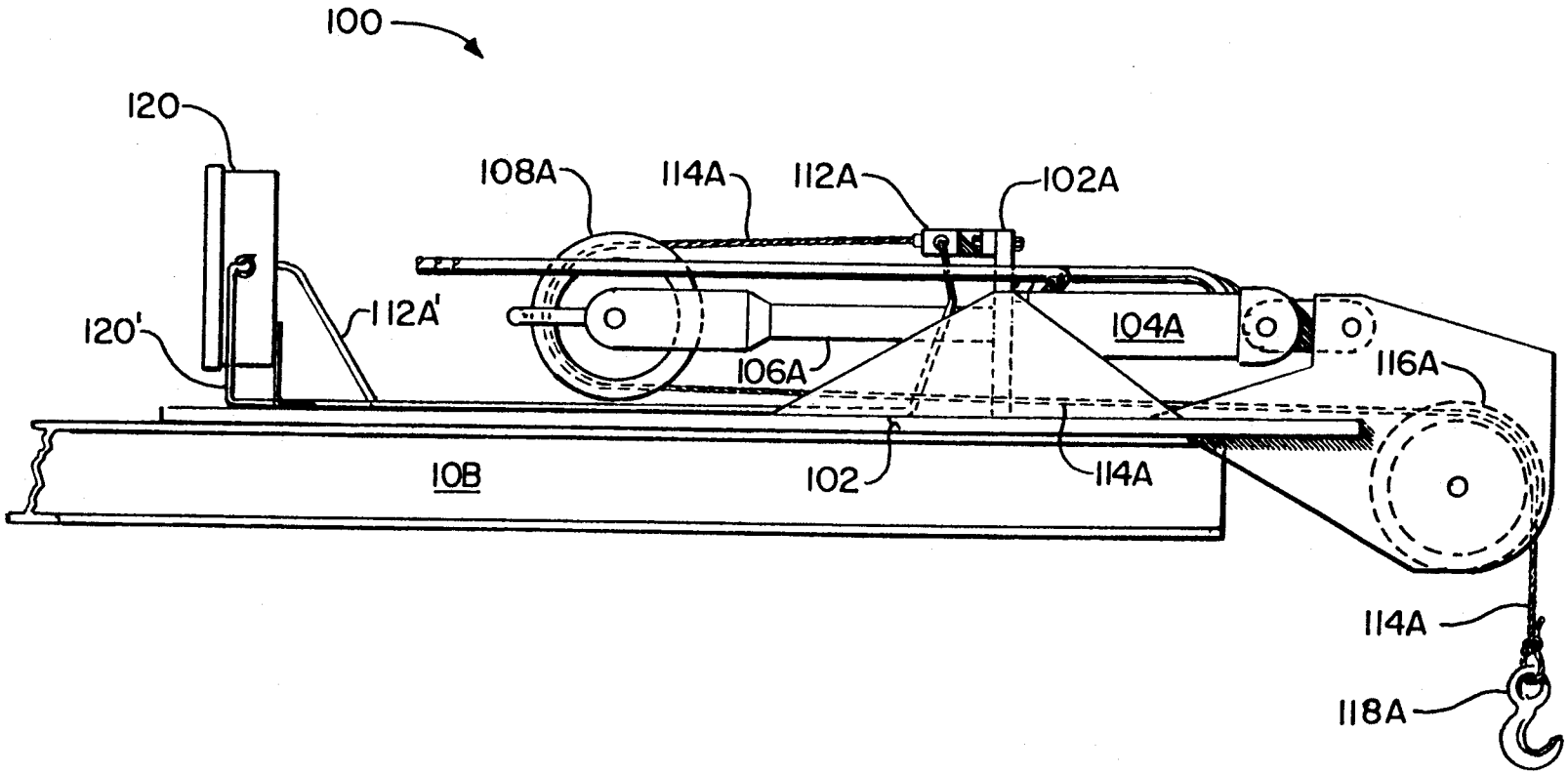
FIG. 3 is a side elevational view of the multiple-cable lifting head of the FIG. 2.
Figure 4:
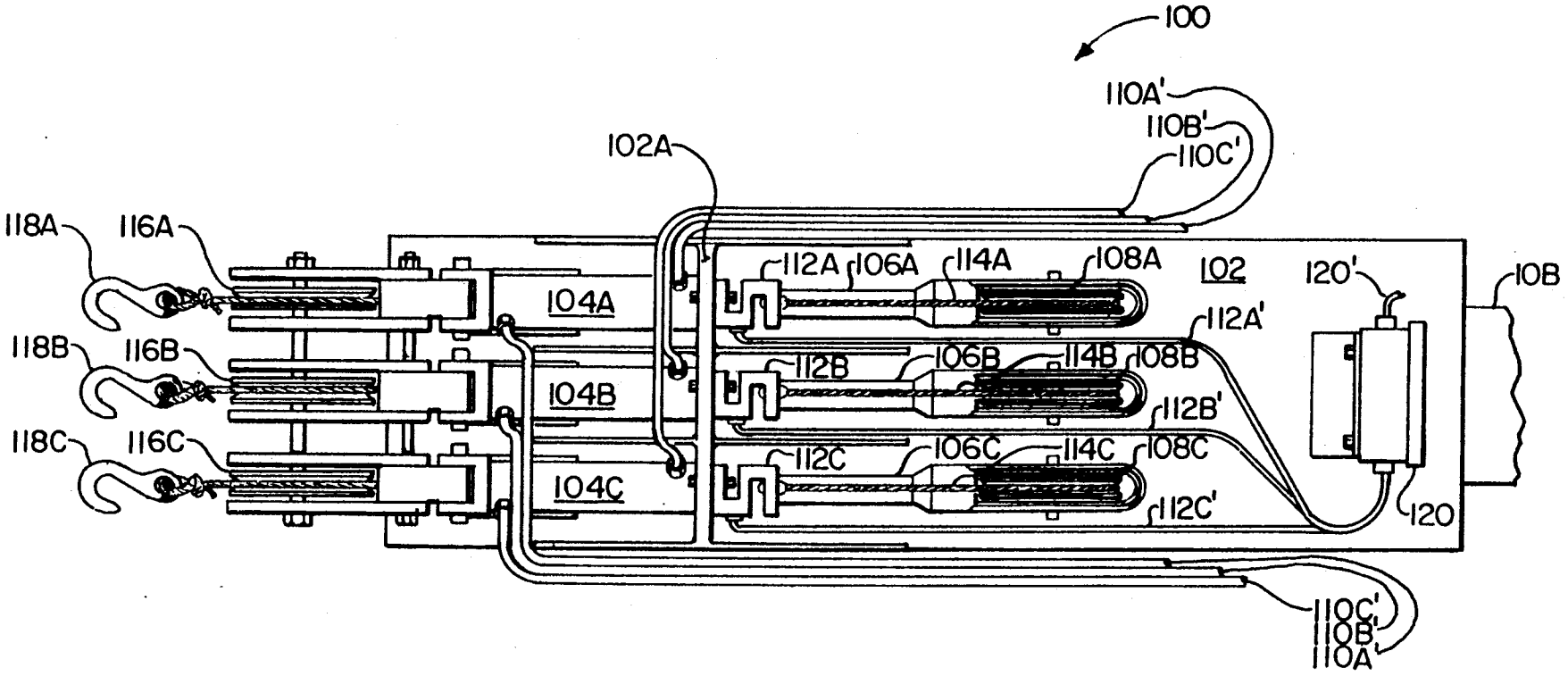
FIG. 4 is a top plan view of the multiple-cable lifting head of FIG. 2.

Referring now specifically to FIGS. 2–4, lifting head apparatus 100 is mounted on the free end of upper boom arm 10B for manipulation and weighing of "IGLOO" container 14. Applicant wishes to note that although the detailed description specifically speaks of "IGLOO" container 14, applicant contemplates that lifting head apparatus 100 can be used for manipulation and weighing of other types of recyclable waste containers as well as other apparatus lending themselves to operation and weighing by the apparatus of the instant invention.

Lifting head apparatus 100 comprises a support frame 102 which is mounted directly to upper boom arm 10B by conventional securement means (not shown) which are well known to those skilled in the art. A cover is most suitably provided for apparatus 100, but it is not shown in FIGS. 2–4 in order to better depict the components and construction of lifting head apparatus 100. Three double-acting hydraulic cylinders 104A–104C are mounted to frame 102 so that their corresponding reciprocating piston arms 106A–106C will be extended outwardly away from the terminal end of upper boom arm 10B toward the juncture of upper boom arm 10B with lower boom arm 10A (see particularly FIG. 2), and piston arms 106A–106C will be retracted inwardly toward the terminal end of upper boom arm 10B. Sheaves 108A–108C are mounted to corresponding piston arms 106A–106B and are reciprocated inwardly and outwardly thereby in response to selective actuation of hydraulic cylinders 104A–104C. As best described with reference to FIG. 2, hydraulic valve controls 110A–110C of hydraulic valve control means 110 are provided for selectively actuating fluidly connected corresponding hydraulic cylinders 104A–104C so as to selectively extend or retract reciprocating piston arms 106A–106C. As noted hereinabove and as shown in FIG. 1 of the drawings, hydraulic valve controls 110A–110C are provided at seat station 16 remote from lifting head apparatus 100. Hydraulic valve controls 110A–110C are fluidly connected to corresponding double-acting hydraulic cylinders 104A–104C by corresponding hydraulic fluid lines 110A'–110C'. Hydraulic valve control means 110 comprising hydraulic valve controls 110A–110C are in fluid connection with a conventional hydraulic pump circuit (not shown) which would be familiar to one skilled in the art.

With reference again to FIGS. 2–4, it can be seen that force transducers or load cells 112A–112C are mounted to upstanding mounting plate 102A of support frame 102 so as to be adjacent and operably associated with respective hydraulic cylinders 106A–106C. Load support cables 114A–114C are provided for extension and retraction by corresponding hydraulic cylinders 106A–106C and are each fixed at one end thereof to a respective one of load cells 112A–112C. Cables 114A–114C extend from their respective fixed ends around corresponding sheaves 108A–108C and then back toward the free end of upper boom arm 10B and around corresponding pulleys 116A–116C with their free ends terminating in hooks 118A–118C. Thus, the force applied to cables 114A–114C is detected at the fixed end thereof by respective load cells 112A–112C and the resulting electrical signal carried by electrical connector wires 112A'–112C' to junction box (J Box) 120 which serves to sum the signal output from load cells 112A–112C. The electrical signal is in turn carried by electrical wire 120' to weight scale indicator 130 adjacent operator seat station 16 at the base of knuckle boom lifting crane 10. Weight scale indicator 130 may be any suitable device for converting the electrical signal from J Box 120 to a digital weight measurement readout. Most suitably, scale indicator 130 includes computing means for manipulating the signal data received from load cells 112A–112C of lifting head apparatus 100 to better facilitate manipulation and weighing of "IGLOO" containers 14 by the operator at seat station 16.

Applicant contemplates that other embodiments of the lifting head apparatus can be made in accordance with the instant invention. By way of example but not of limitation, the apparatus could be constructed with two cables wherein one of the two cables is linearly movable by a sheave actuated by a hydraulic cylinder and the other cable is non-movable or fixed. The fixed cable does not extend around a movable sheave but instead extends directly from a corresponding load cell to a corresponding pulley at the front end of the lifting head apparatus. The provision of a load cell on both the movable and fixed cables has been found to provide substantially greater accuracy then would be achieved with only a single load cell on the movable cable.

Although the selection of component parts for the construction of the lifting head apparatus of the present invention is largely a matter of choice, applicant has discovered the following elements to be particularly appropriate for use in the instant invention: (1) a SENSOTRONIC Model 20034-3 J Box; (2) a FAIRBANKS Model H90-5200 weight scale indicator; and (3) a SEN- SOTRONIC Model 60001-3k NTEP Certified strain gauge-type load cells. Of course, other components may be utilized in the practice of applicant's invention and are clearly contemplated for use therein by the applicant.

Furthermore, as noted above, applicant contemplates that the instant lifting head apparatus of the present invention could be utilized as follows: (1) to operate one door "IGLOOs" by securing one cable to the fixed ring at the top thereof and two cables to the ring controlling the bottom trap door; (2) to operate two door "IGLOOs" by securing one cable to the fixed ring at the top thereof and a singular cable to each of the two rings controlling the two bottom trap doors thereof; and (3) to operate three door "IGLOOs" by securing one cable to each of the three rings controlling the three trap doors thereof (since, as known to those skilled in the art, the three door "IGLOO" recyclable waste container does not contain a fixed ring secured to the shell thereof as do the one and two door containers). Other types of containers and apparatus may be manipulated and weighed with the apparatus of the present invention consistent with the plethora of potential applications thereof.

In use, the operator of knuckle boom 10 located at seat position 16 maneuvers the knuckle boom into position so that hooks 118A–118C are positioned over the corresponding rings 14A–14C at the top of "IGLOO" container 14 (see FIG. 2). In the two door "IGLOO" container shown in part at FIG. 2, the middle ring secured by hook 118B is fixed to the "IGLOO" frame and the two remaining rings 14A–14C are engaged by remaining hooks 118A and 118C. Cables 114A–114C are adjusted by extending and/or retracting piston arms 106A–106C of hydraulic cylinders 104A–104C so as to withdraw and/or extend sheaves 108A–108C which determines the linear movement of the cables wrapped therearound. After cables 114A–114C have been adjusted by selectively actuating hydraulic cylinders 104A–104C by means of hydraulic control means 110 to close the doors of "IGLOO" container 14, the container is lifted upwardly and laterally by knuckle boom 10 so as to be positioned over the collection bin of truck 12. The lifting movement from the initial ground site of "IGLOO" container 14 into the recyclable waste dumping position over the waste collection bin of truck 12 is momentarily stopped in order to determine the weight of "IGLOO" container 14 and its contents on scale indicator 130. Thereafter, cables 114A and 114C are withdrawn relative to cable 114B by selectively actuating hydraulic cylinders 104A and 104C (and extending piston arms 106A and 106C) by means of hydraulic control valves 110A and 110C. The contents of "IGLOO" container 14 are thereby discharged into the waste collection bin of truck 12 and hydraulic cylinders 104A and 104C are again actuated so as to withdraw piston arms 106A and 106C (and sheaves 108A and 108C) inwardly to thereby extend cables 114A and 114C which serves to close the two bottom trap doors of "IGLOO" container 14. Knuckle boom lifting crane 10 then moves "IGLOO" container 14 back towards its original location on the ground adjacent truck 12. However, lifting crane 10 momentarily halts just before placing "IGLOO" container 12 onto its original site in order that a weight reading of the empty container may be obtained from weight scale indicator 130 by the operator at seat station 16. The weight of the "IGLOO" container contents are then suitably calculated in order to determine the precise weight of the recyclable waste collected from "IGLOO" container 14.

It will be understood that various details of the invention may be changed without departing from the scope of the invention. Furthermore, the foregoing description is for the purpose of illustration only, and not for the purpose of limitation—the invention being defined by the claims.

What is claimed is:

1. A load weighing lifting head for use in combination with knuckle boom and crane-type lifting arms, said lifting head comprising:

a support frame adapted for mounting to the free end of said lifting arm and defining a front end and a rear end;

at least one double acting hydraulic cylinder mounted on said support frame wherein said cylinder includes a reciprocating piston arm;

hydraulic control means for selectively actuating said hydraulic cylinder;

at least one sheave means wherein said sheave means is operatively connected to said piston arm of said hydraulic cylinder for being extended and retracted relative to said cylinder;

a plurality of force detection means mounted on said support frame wherein at least one is operatively associated with said hydraulic cylinder and said sheave means;

a plurality of load support cables wherein at least one of said cables is operably movable by said sheave means so as to be extended when said sheave means is extended and retracted when said sheave means is retracted, said load support cables each being secured at one end thereof to a respective one of said plurality of force detection means and the other end thereof being free to secure a load; and circuit means electrically connected to said plurality of force detection means for measuring the weight of the load supported by said load support cables.

2. A load weighing lifting head according to claim 1 wherein said at least one double acting hydraulic cylinder comprises three hydraulic cylinders.

3. A load weighing lifting head according to claim 2 wherein said hydraulic cylinder is mounted on said support frame so that said reciprocating piston arm thereof and said sheave means operatively connected thereto extend outwardly towards the rear end of said support frame and retract inwardly towards the front end of said support frame.

4. A load weighing lifting head according to claim 1 wherein said hydraulic control means comprises a hydraulic valve control for said hydraulic cylinder.

5. A load weighing lifting head according to claim 1 wherein said force detection means comprise force transducers.

6. A load weighing lifting head according to claim 5 wherein said force transducers comprise strain gauge-type load cells.

7. A load weighing lifting head according to claim 1 wherein said load support cables comprise wire cables.

8. A load weighing lifting head according to claim wherein a hook is attached to the free end of each of said wire cables for securement to a load.

9. A load weighing lifting head according to claim wherein said circuit means comprises a junction box mounted to said support frame of said lifting head and electrically connected to said plurality of force detection means and a remote weight indicator electrically connected to said junction box.

10. A load weighing lifting head for use in combination with knuckle boom and crane-type lifting arms, said lifting head comprising:

a support frame adapted for mounting to the free end of said lifting arm and defining a front end and a rear end;

a plurality of double acting hydraulic cylinders mounted on said support frame wherein each of said cylinders includes a reciprocating piston arm;

hydraulic control means for selectively actuating said hydraulic cylinders;

a plurality of sheave means wherein each of said sheave means is operatively connected to a respective one of said piston arms of said plurality of hydraulic cylinders for being extended and retracted relative to said cylinders;

a plurality of force detection means mounted on said support frame and each being operatively associated with a respective one of said plurality of hydraulic cylinders;

a plurality of load support cables wherein each of said cables is operably movable by a respective one of said sheave means so as to be extended when said sheave means is extended and retracted when said sheave means is retracted, said load support cables each being secured at one end thereof to a respective one of said plurality of force detection means and the other end thereof being free to secure a load; and circuit means electrically connected to said plurality of force detection means for measuring the weight of the load supported by said load support cables.

11. A load weighing lifting head according to claim wherein said plurality of double acting hydraulic cylinders comprises three hydraulic cylinders.

12. A load weighing lifting head according to claim wherein said hydraulic cylinders are mounted on said support frame so that said reciprocating piston arms thereof and said sheave means operatively connected thereto extend outwardly towards the rear end of said support frame and retract inwardly towards the front end of said support frame.

13. A load weighing lifting head according to claim 10 wherein said hydraulic control means comprises a hydraulic valve control for each of said hydraulic cylinders.

14. A load weighing lifting head according to claim 10 wherein said force detection means comprise force transducers.

15. A load weighing lifting head according to claim 14 wherein said force transducers comprise strain gauge-type load cells.

16. A load weighing lifting head according to claim 10 wherein said load support cables comprise wire cables.

17. A load weighing lifting head according to claim 16 wherein a hook is attached to the free end of each of said wire cables for securement to a load.

18. A load weighing lifting head according to claim 10 wherein said circuit means comprises a junction box mounted to said support frame of said lifting head and electrically connected to said plurality of force detection means and a remote weight indicator electrically connected to said junction box.

19. A load weighing lifting head for use in combination with knuckle boom and crane-type lifting arms, said lifting head comprising:

a support frame adapted for mounting to the free end of said lifting arm and defining a front end and a rear end;

a plurality of double acting hydraulic cylinders mounted on said support frame wherein each of said cylinders includes a reciprocating piston arm and wherein said hydraulic cylinders are mounted so that said reciprocating piston arms thereof extend outwardly towards the rear end of said support frame and retract inwardly towards the front end of said support frame;

hydraulic valve control means for selectively actuating said hydraulic cylinders;

a plurality of sheave means wherein each of said sheave means is operatively connected to a respective one of said piston arms of said plurality of hydraulic cylinders for being extended and retracted relative to said cylinders;

a plurality of load cells mounted on said support frame and each being operatively associated with a respective one of said plurality of hydraulic cylinders;

a plurality of load support cables wherein each of said cables is operably movable by a respective one of said sheave means so as to be extended when said sheave means is extended and retracted when said sheave means is retracted, said load support cables each being secured at one end thereof to a respective one of said plurality of load cells and the other end thereof being free to secure a load; and circuit means electrically connected to said plurality of load cells for measuring the weight of the load supported by said load support cables.

20. A load weighing lifting head according to claim wherein said plurality of double acting hydraulic cylinders comprises three hydraulic cylinders.

21. A load weighing lifting head according to claim wherein said load support cables comprise wire cables.

22. A load weighing lifting head according to claim wherein a hook is attached to the free end of each of said wire cables for securement to a load.

23. A load weighing lifting head according to claim wherein said circuit means comprises a junction box mounted to said support frame of said lifting head and electrically connected to said plurality of load cells and a remote weight indicator electrically connected to said junction box.

* * * * *